United States Patent [19]

Peelle, Jr. et al.

[11] Patent Number: 4,984,658

[45] Date of Patent: Jan. 15, 1990

[54] CAR GATE REVERSING EDGE

[75] Inventors: H. E. Peelle, Jr., Manhasset; I-Lin Chang, Setauket; Stefan Walkowiak, St. James, all of N.Y.

[73] Assignee: The Peelle Company, Bay Shore, N.Y.

[21] Appl. No.: 468,226

[22] Filed: Jan. 22, 1990

[51] Int. Cl.[5] ..... B66B 13/24

[52] U.S. Cl. ..... 187/58; 187/51; 187/52 R; 187/104; 49/25

[58] Field of Search ..... 49/25; 187/DIG. 1, 104, 187/56, 58, 51, 52 LC, 52 R

[56] References Cited

U.S. PATENT DOCUMENTS

| | | | |
|---|---|---|---|
| 1,142,405 | 6/1915 | Derry | 187/58 |
| 4,621,452 | 11/1986 | Deeg | 187/52 R X |
| 4,794,248 | 12/1988 | Gray | 187/56 X |

*Primary Examiner*—H. Grant Skaggs
*Assistant Examiner*—Dean A. Reichard
*Attorney, Agent, or Firm*—Pearne, Gordon, McCoy & Granger

[57] ABSTRACT

The invention provides a scanning beam along the forward edge of an elevator car closure which leads the edge a predetermined distance to provide sufficient time when an object interrupts the beam to stop or reverse the closure and which retracts relative to the closure during final closing movement to dwell adjacent the line at which the closure forward edge closes.

7 Claims, 3 Drawing Sheets

CAR GATE REVERSING EDGE

BACKGROUND OF THE INVENTION

The invention relates to elevator control and, more particularly, to a method and apparatus for sensing an object in the path of an elevator car closure.

PRIOR ART

It is known from U.S. Pat. No. 4,452,009, for example, to sense objects in the path of horizontally sliding passenger elevator doors with a light beam. U.S. Pat. No. 4,274,226 discloses an automobile parking system in which a vertically sliding gate on an elevator car or lift has a microwave radiation beam to sense the presence of objects in the path of the gate. The radiation beam in this patent is set at a fixed distance below the lower edge of the gate. In the systems disclosed in the aforementioned patents, and like systems, a signal from a radiation detector sensing the presence of an object in the path of the elevator door or gate can be used to interrupt power to an automatic closing device.

SUMMARY OF THE INVENTION

The invention provides a method and apparatus for controlling the power operation of an automatic elevator car gate with a beam of radiation that leads the forward edge of the gate by a certain distance to scan for an obstacle until the gate approaches its fully closed position when it monitors the narrowing gap at the gate edge. In the disclosed embodiment, the invention is applied to a vertically sliding gate such as used on a freight elevator. The scanning beam is established between radiation projecting and receiving elements at opposite sides, i.e. vertical edges of the gate. These beam projecting and receiving elements are suspended on carriages that travel with the gate. The carriages support the beam projecting and receiving elements a certain lead distance below the lower edge of the gate when the gate is travelling towards its closed position. In the final stage of closing motion, where the gap of the gate from full close is less than the lead distance, the carriages retract relative to the car gate while the beam is maintained at the threshold.

The scanning beam has the ability to detect the presence of an object in the path of the gate when it is being closed under automatic control. If an object is detected by interruption of the beam a signal is generated to automatically stop or reverse direction of a motor controlling the motion of the gate. The lead of the beam, ideally, gives sufficient time to reverse the gate drive motor or otherwise stop advance of the gate before it strikes the detected object.

In the final closing stage of the gate, the beam projecting and receiving elements lie immediately above the floor of the elevator car where they provide a beam which can detect the presence or entry of an object even in the last moments of closing action. For example, a passenger or freight handler's foot on the floor of the elevator in the path of the car gate can be detected by the beam.

The beam projecting and receiving elements and their respective carriages are simple mechanisms capable of reliable, long term, maintenance free operation. Further, these elements and carriages are carried exclusively on the car gate and do not require special modifications or installations of components on the floor of the car. The disclosed beam scanning arrangement is particularly suited for freight elevators which are frequently custom-sized for specific applications since the arrangement is substantially unaffected by normal variations in elevator width, height, mass or environment.

DESCRIPTION OF THE PREFERRED EMBODIMENT

Figure 1:
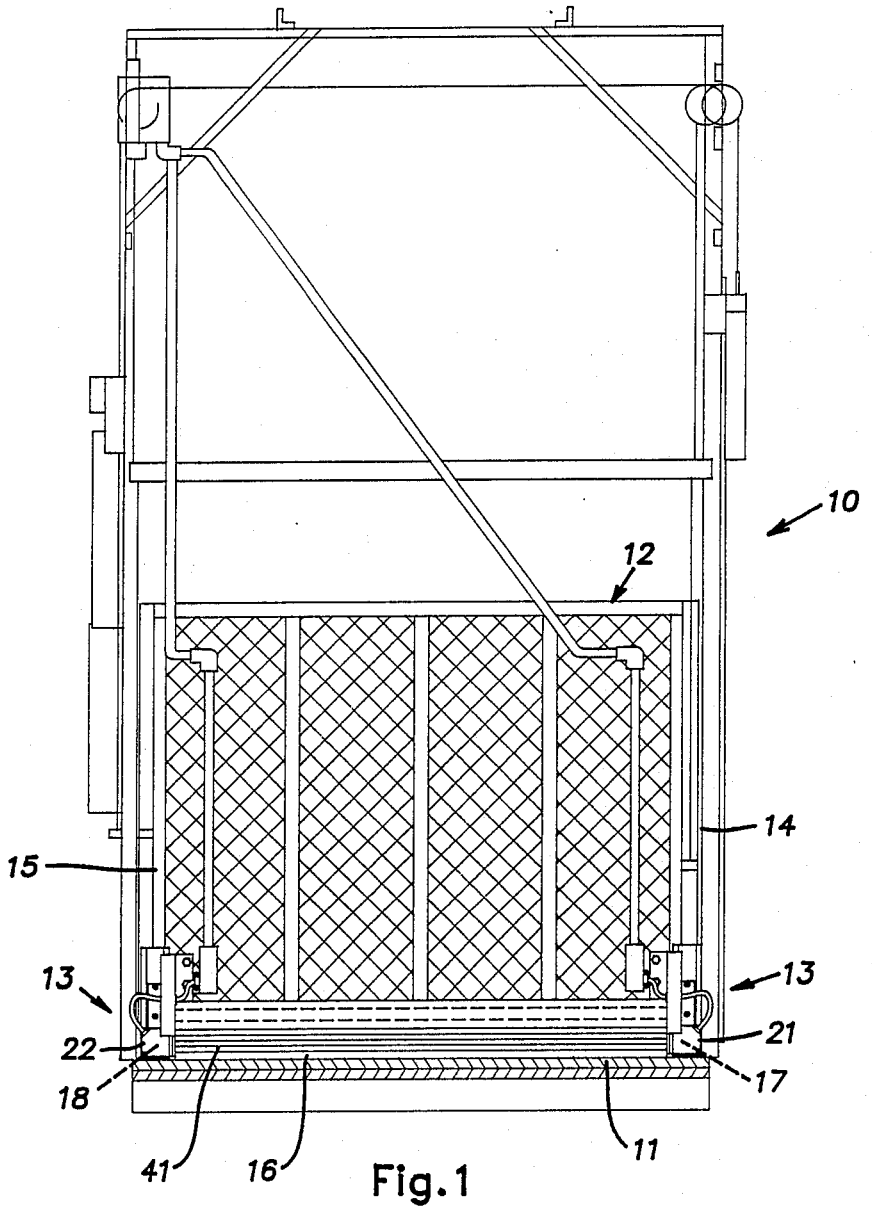
FIG. 1 is an elevational view of an elevator car gate as seen from the inside of the car.
Figure 2:
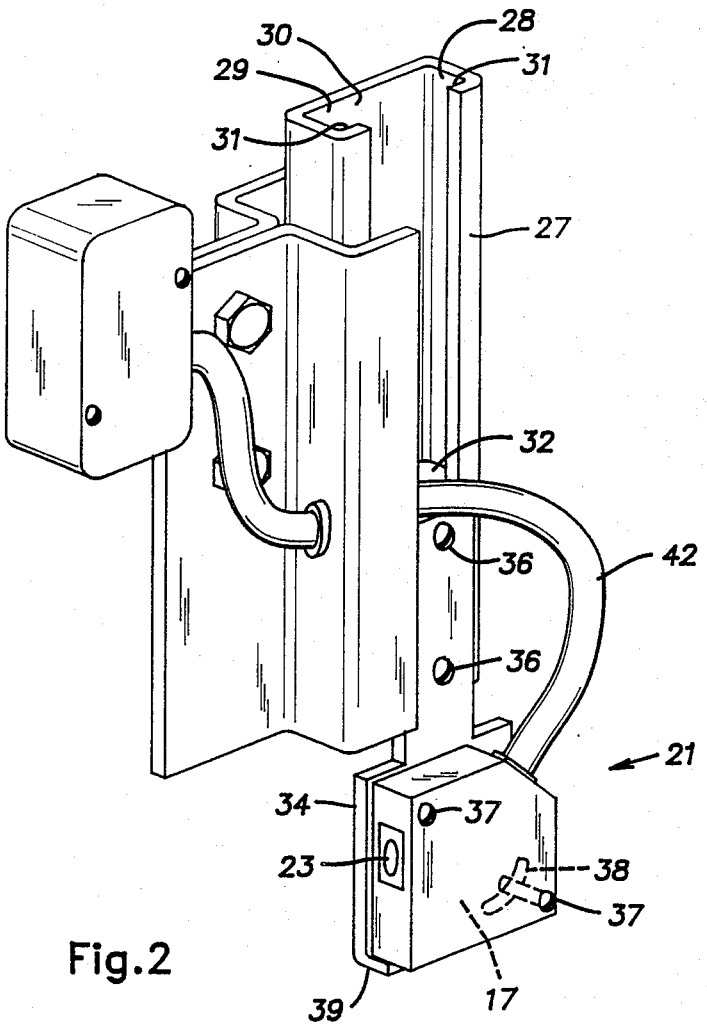
FIG. 2 is a perspective view of a typical beam scanning element at one side of the lower edge of the car gate.

Referring now to the drawings there is partially illustrated an elevator car 10. The car 10 is guided and powered in a known manner for vertical travel in a hoistway between landings at which an edge of a floor 11 of the car is aligned with the landing floor edge. The car 10 includes a closure in the form of a wire mesh gate 12. The gate 12 is mounted on the car 10 for relative vertical sliding motion between an open position where it provides access and egress between the car and landing and a closed position where it restrains objects on the car from falling or engaging the walls of the hoistway. Automatic opening and closing motion of the gate 12 on the car 10 is powered by a reversible motor (not shown) in a known manner.

In a manner to be described, a scanning apparatus 13 having parts adjacent each vertical side or edge 14, 15 of the gate 12 protects a lower edge 16 of the gate from striking an object in its path during closing motion. The scanning apparatus 13 includes beam projecting and receiving elements 17, 18, respectively, which in the illustrated case utilize electromagnetic radiation in the infrared range. The elements, which are commercially available are a source 17 of an infrared radiation beam and a photoswitch 18 that receives such beam radiation. In the illustrated example, the beam projecting and receiving elements 17, 18 are enclosed in generally identically dimensioned block-like housings 21, 22. Each block 21, 22 has a lens or aperture 23 through which the infrared beam passes. The lens or aperture 23 of each block 21, 22 is aimed at that of the other. The manner of mounting the beam projecting and receiving elements 17, 18 on the gate 12 is essentially the same. The right side of the gate 12, as viewed in FIG. 1, is described hereinbelow and it will be understood that the left side of the gate is essentially a mirror image of the right.

Figure 5:
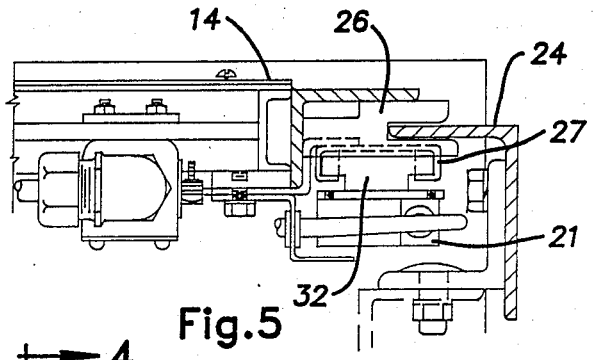
FIG. 5 is a plan sectional view taken in the plane 5—5 in FIG. 3.

The gate 12 is guided for vertical movement on the car 10 by main rails 24 (FIG. 5) engaged by shoe assemblies 26 fixed to the gate. Also fixed to the gate 12 near its lower edge 16 is a vertically oriented guide track 27. The guide track 27 is C-shaped in horizontal or transverse section so that it provides vertical opposed surfaces 28, 29 and 30, 31.

A guide shoe 32 is assembled in the guide track 27. The guide shoe has a T-shaped cross-section dimensioned to slide smoothly in the vertical track 27 with limited lateral clearance. A lower end of the track 27 is at least partially blocked at a point 33 to limit downward movement of the guide shoe 32 beyond this point. The guide shoe 32 forms a carriage for the associated scanning beam housing 21. The scanning beam housing 21 is supported on the guide shoe or carriage 32 through an inverted T-shaped bracket plate 34 fixed to the guide shoe by screws 36. The scanning beam housing 21 is mounted to the bracket plate 34 by screws 37, one of which extends through an arcuate slot 38 in the plate 34. The slot 38 allows the housing 21 to be rotated about a horizontal axis corresponding to the other screw 37 for limited adjustment of the housing so that the beam projected from its aperture 23 strikes the aperture of the opposite housing 22. The carriage bracket plate 34 includes a tab 39 bent out of its plane beneath the housing 21.

Figure 4:
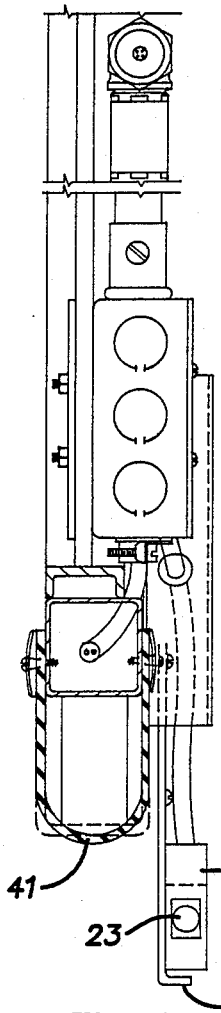
FIG. 4 is an elevational sectional view taken in the plane 4—4 in FIG. 3.
Figure 3:
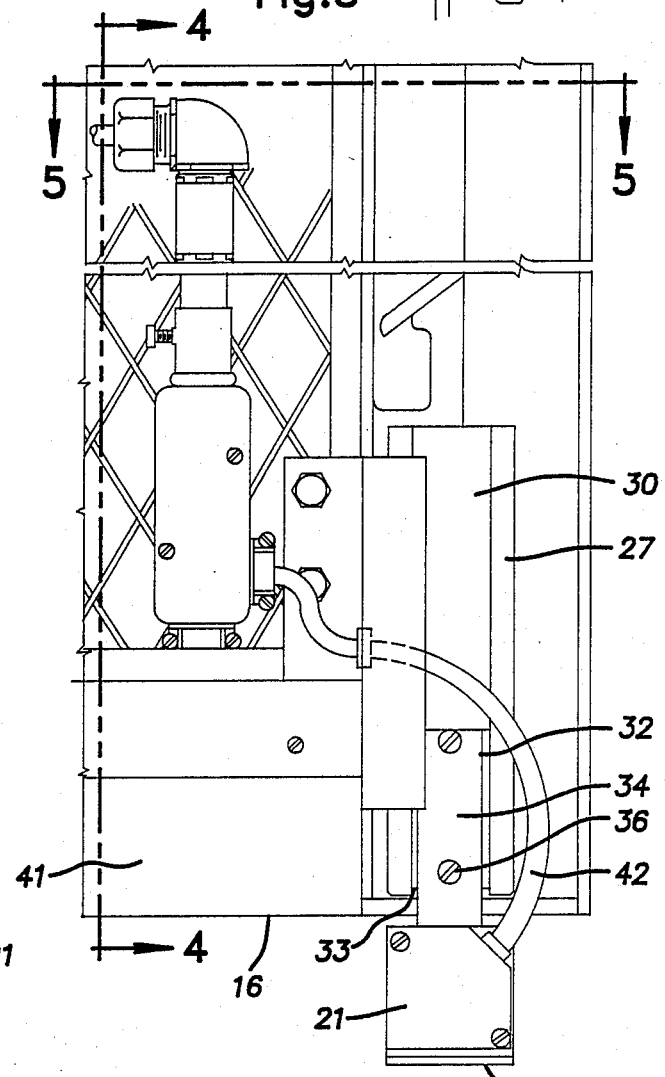
FIG. 3 is a fragmentary elevational view of the lower right-hand side of the car gate shown in FIG. 1.

The lower edge 16 of the gate 12 is formed by a resilient astragal 41 which is adapted to rest on the floor 11 of the car 10 when the gate is fully closed. The bracket plate 34 is proportioned to suspend the scanning beam housing 21 at a point where its aperture 23 is a predetermined distance, for example, of 2 to 3" below the astragal edge 16. As shown in FIG. 4, the scanning beam housing 21 lies in a vertical plane at the inside face of the gate 12. A flexible electrical cable 42 conducts power and/or signals between the scanning beam element 17 and a remote controller for the elevator car. FIGS. 3 and 4 represent a condition where the gate 12 is displaced from its closed position. It will be understood from the foregoing that in this condition the infrared scanning beam is projected from the aperture 23 of the housing 21 to corresponding components 23, 22 on the opposite side 15 of the gate along a path that is parallel to and spaced a predetermined distance below the lower edge 16 of the astragal 41. The beam is also spaced slightly inward of the plane of the gate 12. As the gate 12 is lowered by automatic controls from an open position and its lower edge 16 closely approaches the car floor 11, the carriage bracket tabs 39 first engage the floor 11. This contact arrests movement of the respective scanning beam housings 21, 22 as well as their associated guide shoe carriages 32 as the gate 12 thereafter ordinarily completes its closing motion. In the arrested position, the scanning beam housings 21, 22 project and receive the infrared beam immediately above the car floor 11 a distance corresponding to the distance that their apertures 23 are spaced above the lower face of the tabs 39.

The beam of radiation projected between the housings 21, 22 scans the space immediately ahead of the gate 12 as it closes. When an object, either animate or inanimate, blocks the beam, the beam receiving element 18 transmits a signal to the main controller to stop and/or reverse closing movement of the gate 12. Preferably, the beam is spaced ahead of the gate 12 a distance that yields sufficient time to arrest forward motion of the gate before the detected object is struck. The beam projecting and receiving elements 17, 18 can maintain the beam when they are arrested by contact of the carriage bracket tabs 39 at the floor 11 to scan the zone immediately above the threshold of the gate opening. This feature can detect a freight handler's foot encroaching into the path of the gate 12 even at the last moment.

It will be understood from the foregoing description that the beam projecting and receiving elements 17, 18 along with the respective carriage guide shoes 32 are characterized by simplicity and ruggedness. The guide shoe carriages 32 rely simply on gravity to slide down their guide tracks 27 to resiliently extend the beam scanning elements 16, 17 below the lower gate edge 16. The guide shoe carriages 32 are independent of one another so that if the tab 39 of one carriage bracket 34 cannot rest on the floor 11, the other carriage guide shoe 32 is not obstructed. However, where one of the scanning beam projecting and receiving elements 17 or 18 encounters an obstacle its resultant horizontal misalignment with the other will simulate a blockage of the scanning beam and effect an appropriate signal at the receiving element 18. As seen, the scanning beam projecting and receiving elements 17, 18 monitor essentially the full width of the gate 12.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An elevator car having a floor terminating at an edge adapted to register with an edge of a landing served by the car, a gate mounted on the car for relative vertical movement above the car floor edge between open and closed positions to provide in the open position access and egress to the car at a landing and in the closed position restraining objects on a car when travelling between landings, the gate having a lower edge adapted to rest on or adjacent the car floor edge when in the closed position, means at one side of the gate projecting a source of radiation in a path parallel to the lower edge of the gate and means on the opposite side of the gate for receiving said radiation, means for supporting said radiation projecting and receiving means at each side of the gate at a predetermined distance below the lower gate edge when the lower gate edge is above the car floor distances greater than said predetermined distance and immediately above said floor when the lower gate edge is in an approach zone closer to said car floor than said predetermined distance.

2. An elevator car as set forth in claim 1 wherein said support means includes a vertical guide for vertical movement of said radiation projecting and receiving means relative to said car gate.

3. An elevator car as set forth in claim 2, wherein said support means allows independent vertical movement of said radiation projecting and receiving means.

4. An elevator car as set forth in claim 3, wherein said support means includes an element adapted to engage and be arrested by the car floor when the lower gate edge is in said approach zone.

5. An elevator car as set forth in claim 3, wherein said support means allows said radiation projecting and receiving means to be resiliently held below the lower gate edge.

6. An elevator car as set forth in claim 5, wherein said support means is arranged to permit gravity to provide a principal force for resiliently holding said projecting and receiving means below said lower gate edge.

7. A method of controlling an automatic power-operated closure on an elevator car comprising providing a radiation beam projector and a beam receiver adjacent opposite ends of the closing edge of the closure, movably supporting the projector and receiver on the closure to establish a radiation beam parallel to and ahead of the closing edge of the closure at a predetermined distance sufficient to sense an interfering object in the path of the closure by interruption of the beam during closing motion and provide a signal sufficiently early to permit the power operator of the closure to stop or reverse the motion of the closure before it strikes the interfering object, and when the closing edge of the closure is within a distance approximating said predetermined distance or less than said predetermined distance, arresting the movement of said beam projector and receiver relative to said car such that said projector and receiver retract relative to said closure while establishing a beam substantially at the line of contact said closing edge makes with said car in its closed position.

* * * * *

UNITED STATES PATENT AND TRADEMARK OFFICE

CERTIFICATE OF CORRECTION

PATENT NO. : 4,984,658

DATED : January 15, 1991

INVENTOR(S) : H. E. Peelle, Jr., et al.

It is certified that error appears in the above-identified patent and that said Letters Patent is hereby corrected as shown below:

On the title page, item (45) Date of patent:

change "January 15, 1990" to --January 15, 1991--.

Signed and Sealed this

Second Day of June, 1992

*Attest:*

DOUGLAS B. COMER

*Attesting Officer*

*Acting Commissioner of Patents and Trademarks*